US007477196B2

(12) United States Patent
Asrani et al.

(10) Patent No.: US 7,477,196 B2
(45) Date of Patent: Jan. 13, 2009

(54) SWITCHED CAPACITIVE PATCH FOR RADIO FREQUENCY ANTENNAS

(75) Inventors: Vijay L. Asrani, Round Lake, IL (US); Adrian Napoles, Lake Villa, IL (US)

(73) Assignee: Motorola, Inc., Schaumburg, IL (US)

( * ) Notice: Subject to any disclaimer, the term of this patent is extended or adjusted under 35 U.S.C. 154(b) by 217 days.

(21) Appl. No.: 11/613,354

(22) Filed: Dec. 20, 2006

(65) Prior Publication Data

US 2008/0150808 A1 Jun. 26, 2008

(51) Int. Cl.
*H01Q 1/38* (2006.01)

(52) U.S. Cl. ..... 343/700 MS

(58) Field of Classification Search ..... 343/700 MS, 343/846–848, 829–830, 70
See application file for complete search history.

(56) References Cited

U.S. PATENT DOCUMENTS

| | | | | |
|---|---|---|---|---|
| 4,571,595 | A | 2/1986 | Phillips et al. | |
| 5,585,810 | A | 12/1996 | Tsuru et al. | |
| 5,995,047 | A * | 11/1999 | Freyssinier et al. | 343/700 MS |
| 6,255,994 | B1 | 7/2001 | Saito | |
| 6,320,547 | B1 * | 11/2001 | Fathy et al. | 343/700 MS |
| 6,326,927 | B1 | 12/2001 | Johnson et al. | |
| 6,650,294 | B2 | 11/2003 | Ying et al. | |
| 6,765,536 | B2 | 7/2004 | Phillips et al. | |
| 6,819,293 | B2 | 11/2004 | De Graauw | |
| 6,933,896 | B2 * | 8/2005 | Sward et al. | 343/702 |
| 7,071,888 | B2 * | 7/2006 | Sievenpiper | 343/745 |
| 7,327,315 | B2 * | 2/2008 | Starkie et al. | 373/700 MS |
| 2003/0210199 | A1 * | 11/2003 | Sward et al. | 343/795 |
| 2003/0210206 | A1 | 11/2003 | Phillips et al. | |
| 2004/0196203 | A1 * | 10/2004 | Lier et al. | 343/824 |
| 2005/0007294 | A1 | 1/2005 | Handelsman | |
| 2005/0057399 | A1 | 3/2005 | Kipnis et al. | |
| 2006/0055606 | A1 | 3/2006 | Boyle | |
| 2006/0139211 | A1 | 6/2006 | Vance et al. | |

FOREIGN PATENT DOCUMENTS

| | | | |
|---|---|---|---|
| EP | 1109251 | | 6/2001 |
| EP | 1317116 | | 6/2003 |
| WO | 02078124 | A1 | 10/2002 |
| WO | 2004097976 | A2 | 11/2004 |

OTHER PUBLICATIONS

International Search Report. PCT/US2007/075421, dated Jan. 16, 2008.

* cited by examiner

*Primary Examiner*—Huedung Mancuso
(74) *Attorney, Agent, or Firm*—Sylvia Chen; Daniel R. Collopy

(57) ABSTRACT

An antenna system (102) for receiving and transmitting radio frequency (RF) signals within a plurality of predetermined RF bands includes a ground leg (202), a feed leg (206), one or more capacitive patches (212) and one or more switching devices (214). The feed leg (206) is coupled to the ground leg (202) at one portion thereof. Each of the one or more switching devices (214) is associated with one capacitive patch (212) and selectably couples its associated capacitive patch (212) to a ground plane (204) in order to receive and transmit RF signals within an associated predetermined RF band.

15 Claims, 5 Drawing Sheets

300

SWITCHED CAPACITIVE PATCH FOR RADIO FREQUENCY ANTENNAS

FIELD OF THE INVENTION

The present invention generally relates to antennas for radio frequency (RF) communication, and more particularly relates to a switched capacitive patch for RF antennas.

BACKGROUND

The trend in cellular telephones is towards smaller handsets with greater capabilities. For example, it is preferable to have a single handset that can communicate on multiple cellular bands. Typically, such handsets include two or more antennas (i.e., multiple feed antennas) tuned to receive and transmit radio frequency (RF) signals within particular bands. However, the multiple antennas require more space in the handset. In addition, tuning the receiver circuitry and the transmitter circuitry to multiple antennas adds complexity to the modulation and demodulation circuitry.

Thus, what is needed is a single feed antenna and a control method for operation of the antenna, wherein the antenna occupies minimal physical volume while selectively covering multiple cellular bands. Furthermore, other desirable features and characteristics will become apparent from the subsequent detailed description and the appended claims, taken in conjunction with the accompanying drawings and this background.

BRIEF DESCRIPTION OF THE DRAWINGS

Embodiments of the invention will hereinafter be described in conjunction with the following drawing figures, wherein like numerals denote like elements.

DETAILED DESCRIPTION

An antenna system for receiving and transmitting radio frequency (RF) signals within a plurality of predetermined RF bands includes a ground leg coupled to a ground plane, a multi-resonant feed leg, one or more capacitive patches, and one or more switching devices. The multi-resonant feed leg is coupled to the ground leg at one portion thereof. Each of the switching devices is associated with one of the capacitive patches and selectably couples its associated capacitive patch to the ground plane in order to receive and transmit RF signals within a predetermined RF band.

The following detailed description is merely exemplary in nature and is not intended to limit the invention or the application and uses of the invention. Furthermore, there is no intention to be bound by any theory presented in the preceding background or the following detailed description.

Figure 1:
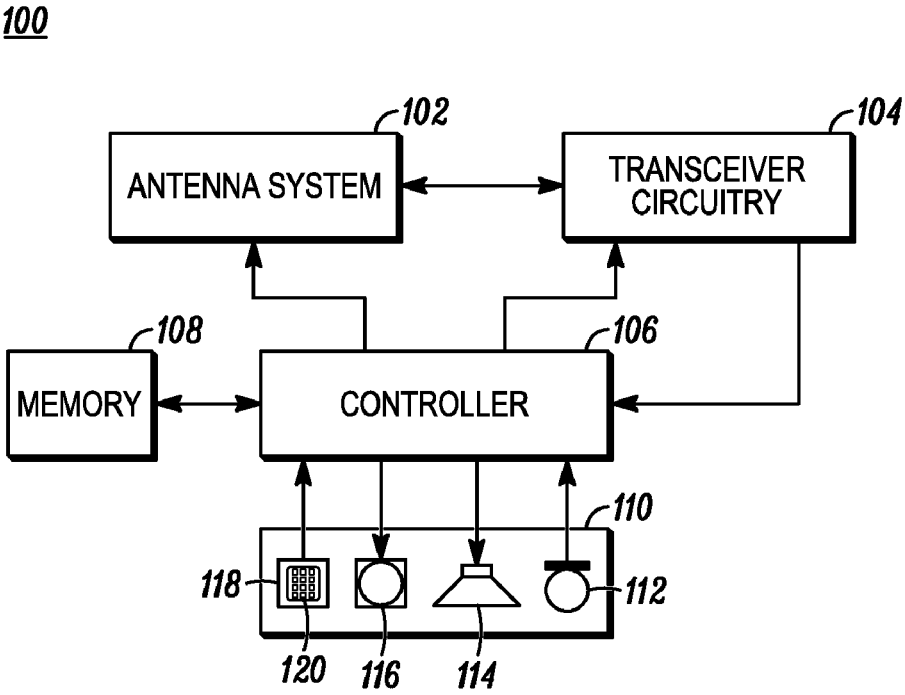
FIG. 1 is a block diagram of a wireless communication device in accordance with an embodiment of the invention.

FIG. 1 shows a block diagram of a wireless communication device 100 in accordance with an embodiment. While the embodiment shown is of a cellular telephone, the wireless communication device could be any device utilizing radio frequency (RF) communication on multiple frequency bands, such as a laptop computer with wireless communication capability, a pager, or a personal digital assistant (PDA) with wireless communication capability. The wireless communication device 100 includes an antenna system 102 for receiving and transmitting RF signals within a plurality of radio frequency bands (RF bands). The antenna system 102 is coupled to transceiver circuitry 104 in a manner familiar to those skilled in the art. The transceiver circuitry 104 includes receiver circuitry and transmitter circuitry. The receiver circuitry demodulates and decodes received RF signals from the antenna system 102 to derive information therefrom and is coupled to a controller 106 and provides the decoded information to the controller 106 for utilization by the controller 106 in accordance with the function(s) of the wireless communication device 100. The controller 106 also provides information to the transmitter circuitry of the transceiver circuitry 104 for encoding and modulating the information into RF signals for transmission from the antenna system 102.

As is well-known in the art, the controller 106 is coupled to a memory 108 which stores data and operational information for use by the controller 106 to perform the functions of the wireless communication device 100. The controller 106 is also coupled to conventional user interface devices 110 such as any or all of a microphone 112, a speaker 114, a display 116, and/or functional key inputs 118, such as a keypad 120.

Figure 2:
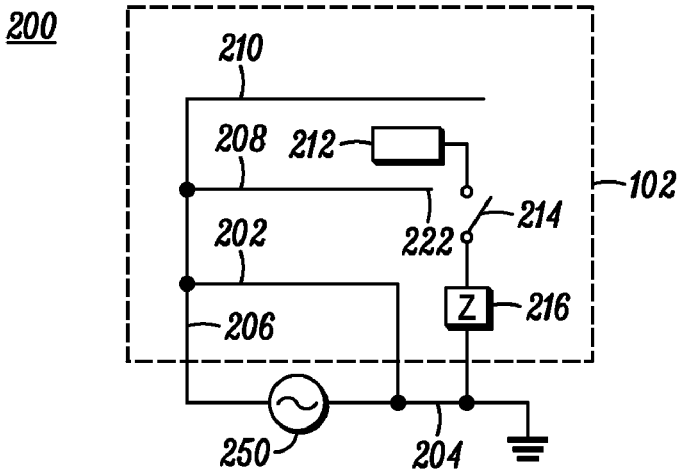
FIG. 2 is an electrical schematic diagram of an antenna system for use in the wireless communication device of FIG. 1 in accordance with a first embodiment of the invention.

Referring to FIG. 2, a schematic diagram of a first embodiment 200 which is suitable for use as the antenna system 102 of FIG. 1 includes a ground leg 202, connected to a ground plane 204 of the wireless communication device 100, and a feed leg 206 connected to a multi-resonant antenna element. The feed leg 206 is connected to the ground leg 202 and is also coupled to the ground plane 204 through a load 250 representative of the circuitry of the wireless communication device 100 where, for example, the feed leg 206 connects to the transceiver circuitry 104 (FIG. 1).

In accordance with this first embodiment 200, the antenna element is an F-shaped antenna element having a first arm 208 and a second arm 210 wherein the first arm 208 is tuned to receive and transmit RF signals within a first predetermined RF band and the second arm 210 is tuned to receive and transmit RF signals within a second predetermined RF band.

Further in accordance with this embodiment 200, the feed leg 206, connected to the antenna element, is capacitively coupleable to a capacitive patch 212 by a switch 214. When the switch 214 is switched into the closed position, the capacitive patch 212 is connected to an impedance device 216 which is connected to the ground plane 204, thereby capacitively coupling the capacitive patch 212 to the arms 208, 210 of the antenna element and altering the impedance of the antenna system 102 in accordance with the embodiment 200. Thus, while the multi-resonant antenna element is designed such that this first embodiment 200 of the antenna system 102 receives and transmits RF signals within the first and the second predetermined RF bands, closing the switch 214 alters the impedance of the antenna system 102 by capacitively coupling the arms 208, 210 of the antenna element to the capacitive patch 212 and the impedance device 216 so that the embodiment 200 receives and transmits RF signals within a third predetermined RF band and a fourth predetermined RF band.

Figure 3:
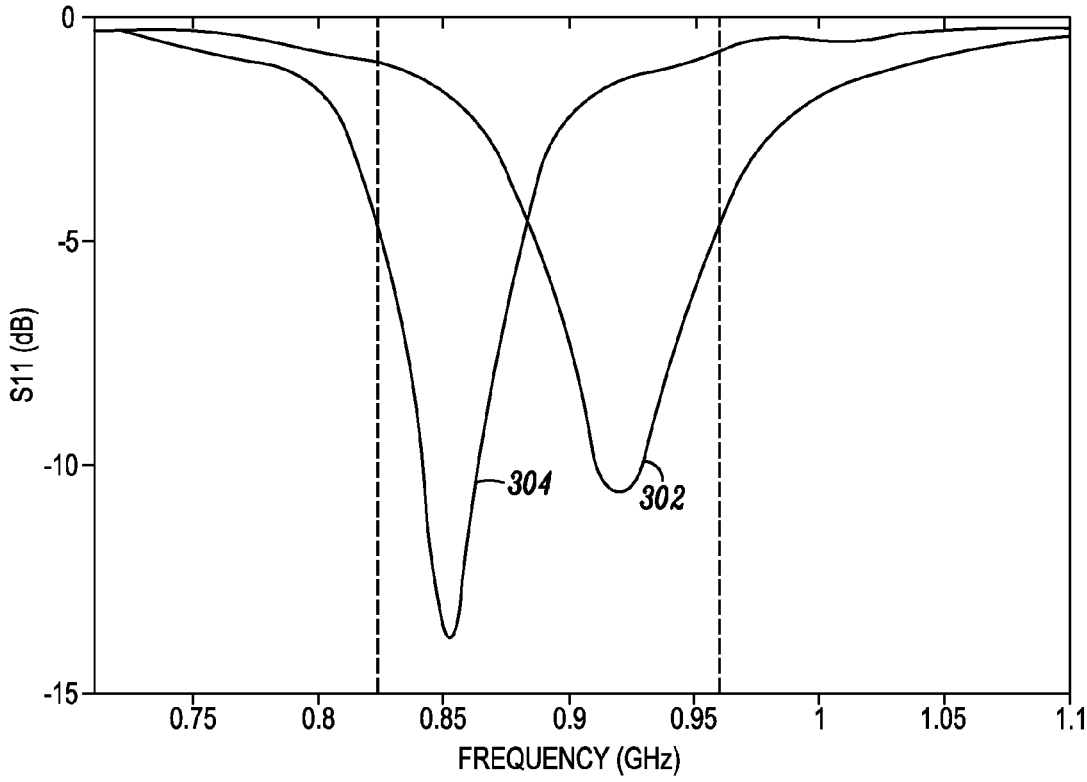
FIG. 3 is a graph of antenna return loss when the switch of FIG. 2 is open and when the switch is closed in accordance with the first embodiment of the invention.

FIG. 3 shows a graph 300 which plots antenna return loss versus frequency in relation to frequency band tuning under the control of the switch 214 shown in FIG. 2. A first curve 302 shows the antenna return loss when the switch 214 is open and the second arm 210 of the antenna element connected to the single feed leg 206 is tuned to receive RF signals from within a cellular Global System for Mobile communications (GSM) 900 MHz RF band. When the switch 214 is closed, capacitively coupling the capacitive patch 212 to the antenna element, the second arm 210 is then tuned to receive RF signals from within the cellular Global System for Mobile communications (GSM) 850 MHz RF band. A second curve 304 shows the antenna return loss when the switch 214 is closed.

Referring back to FIG. 2, while the capacitive patch 212 is depicted as located proximate to both the second arm 210 and an end 222 of the first arm 208 of the antenna element, the capacitive patch 212 could be located proximate to any portion of the first and second arms 208, 210 of the antenna element connected to the feed leg 206. The portion(s) of the antenna element near the location of the capacitive patch 212 are determined based on the desired response at the third and the fourth predetermined RF bands. Thus, switching in the capacitive patch 212 tunes the antenna system 102 to additional predetermined RF band(s). In addition, this alternate embodiment provides tuning by location of a capacitive patch (es) 212 proximally to one or more arms 208, 210 of the antenna element which can provide independent tuning of third and/or fourth predetermined RF bands.

In addition, the single capacitive patch 212 shown could be implemented as multiple capacitive patches, each one adjacent to a predetermined portion of the antenna element so that activation of a particular combination of the capacitive patches would tune the antenna system 102 to the second predetermined RF band. Also, the single switch 214 shown could be implemented as multiple switches. Thus, activation of a portion of the capacitive patches may be designed to tune the antenna system 102 to receive and transmit RF signals within a third predetermined RF band while activation of another portion of the capacitive patches may be designed to tune the antenna system 102 to receive and transmit RF signals within a fourth predetermined RF band.

In accordance with the first embodiment 200, the first arm 208 and the second arm 210 are elements of a low profile antenna element (e.g., a planar antenna element such as a planar inverted-F antenna (PIFA) element) coupled to the ground leg 202 and the feed leg 206. The capacitive patch 212 is also a low profile element and may be an metal structure within the housing of the electronic device 100 such as a metal battery door or other housing component or a vibrator which is located proximate to the antenna element (e.g., at the end 222 of the first arm 208 of the F-shaped multi-resonant antenna element as depicted in FIG. 2). Accordingly, the first embodiment 200 advantageously provides a single feed low profile multi-resonant antenna system 102 which can be provided inside a housing of the wireless communication device 100, even where the housing is a thin housing, because the antenna system 102 occupies minimal physical volume in a relatively planar format while beneficially providing selective tuning to multiple predetermined RF bands.

Figure 4:
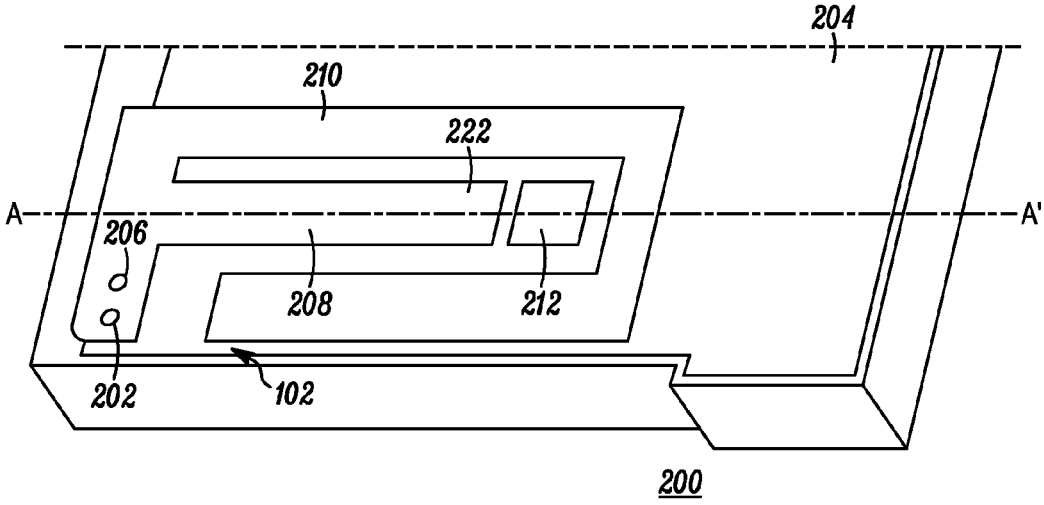
FIG. 4 is a perspective view of the antenna system of FIG. 2 in accordance with the first embodiment of the invention.

Referring to FIG. 4, a three-dimensional view of the low-profile PIFA multi-resonant antenna system 102 in accordance with the first embodiment 200 is shown with the second arm 210 of the PIFA antenna element wrapping around the first arm 208. The PIFA arms 208, 210 and the capacitive patch 212 are located over (by, for example, 5 or 6 millimeters) the circuitry of the wireless communication device 100, including the ground plane 204 (FIG. 2). In order to reduce the profile of the multi-resonant antenna structure 102 in accordance with this first embodiment, the PIFA arms 208, 210 and the capacitive patch 212 can be printed over the ground plane 204 or can be made of stamped metal pieces and located over the ground plane 204 and within a housing of the wireless communication device 100. However, reducing the height of the arms 208, 210 of the antenna element relative to the ground plane 204 reduces the RF bandwidths within which the multi-resonant antenna system 102 can receive and transmit RF signals. Provision of the capacitive patch 212 in accordance with this first embodiment advantageously increases the RF bandwidths and/or the RF bands in which the antenna system 102 can receive and transmit RF signals.

Figure 5:
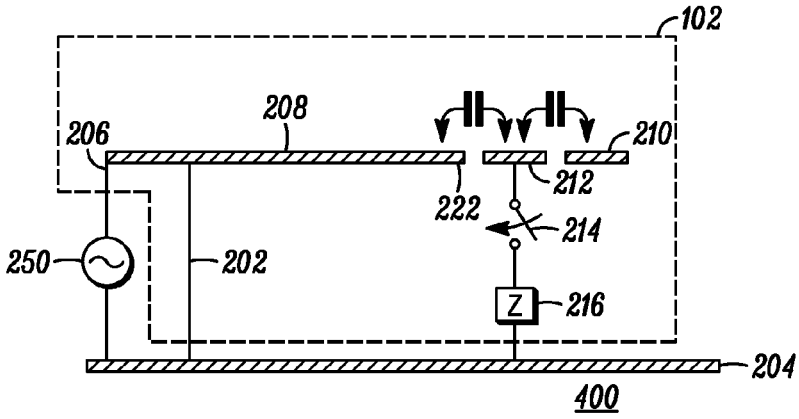
FIG. 5 is a cross-sectional view of the antenna system of FIG. 3 in accordance with the first embodiment of the invention

FIG. 5 shows a cross-sectional view 400 along line A-A' of the low-profile PIFA multi-resonant antenna system 102 of FIG. 4. As can be seen clearly from FIG. 4, activation of the switch 214 to connect the capacitive patch 212 to the impedance device 216 and thence to the ground plane 204 capacitively couples the capacitive patch 212 simultaneously to both the first arm 208 and the second arm 210 due to locating the capacitive patch 212 proximate to both an end 222 of the first arm 208 and a portion of the second arm 210, thereby altering the impedance of the antenna system 102. Therefore, closing the switch 214 retunes the first arm 208 from receiving and transmitting RF signals within the first predetermined RF band to receiving and transmitting RF signals within the third predetermined RF band, while simultaneously retuning the second arm 210 from receiving and transmitting RF signals within the second predetermined RF band to receiving and transmitting RF signals within the fourth predetermined RF band.

Figure 6:
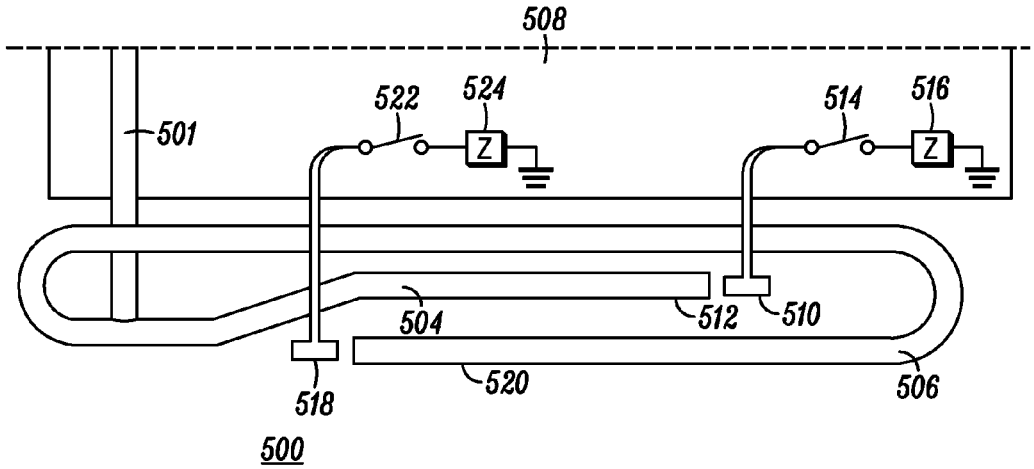
FIG. 6 is a perspective view of an antenna system for use in the wireless communication device of FIG. 1 in accordance with a second embodiment of the invention.

Referring to FIG. 6, a second embodiment 500 shows a low profile multi-resonant folded J (F-J) or dual monopole antenna system 102 with a feed leg 501 for connecting to the circuitry of the wireless communication device 100 and including an antenna element connected to the feed leg 501 and having a first arm 504 and a second arm 506. The first and second arms 504, 506 connect to a ground plane 508 of a wireless communication device 100 and receive RF signals within respective first and second predetermined RF bands. A first capacitive patch 510 is located proximate to an end 512 of the first arm 504 and is capacitively coupleable to the first arm 504 by activation of a switch 514 which connects the capacitive patch 510 to an impedance device 516 connected at one end to the switch 514 and at the other end to the ground plane 508. Thus, the switch 514 selectively couples the capacitive patch 510 to the first arm 504 to selectively alter the impedance thereof from receiving and transmitting RF signals within the first predetermined RF band to receiving and transmitting RF signals within a third predetermined RF band. A second capacitive patch 518 is located proximate to an end 520 of the second arm 506. Activation of a switch 522 connects the capacitive patch 518 to the ground plane 508 via an impedance device 524 thereby capacitively coupling the capacitive patch 518 to the second arm 506 to alter the characteristics thereof from receiving and transmitting RF signals within the second predetermined RF band to receiving and transmitting RF signals within a fourth predetermined RF band.

As can be seen from FIG. 6, the first and second capacitive patches 510, 518, coupleable respectively to the first and second arms 504, 506, can provide a design for a low profile multi-band antenna system 102 which advantageously requires minimal physical volume and is, therefore, suitable for locating within a housing of a compact wireless communication device 100. Also, operation of the switches 514 and 522 can be controlled independently so that multiple permutations of reception of RF signals within the predetermined RF bandwidths can be provided by the antenna system 102, thereby expanding design options for a multi-band antenna system 102.

Figure 7:
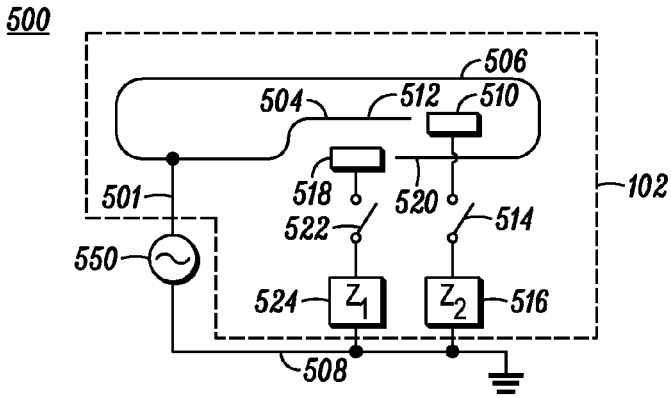
FIG. 7 is an electrical schematic diagram of the antenna system of FIG. 6 in accordance with the second embodiment of the invention.

Referring to FIG. 7, an electrical schematic diagram of the second embodiment 500 for use as the antenna system 102 of FIG. 1 depicts the dual band folded J monopole antenna including the feed leg 501 connected to the first arm 504 and the second arm 506. The feed leg 501 is coupled to one side of a load 550, the other side of the load 550 is coupled to the ground plane 508 of the wireless communication device 100. As described above, the first arm 504 is designed such that the antenna system 102 in accordance with the embodiment 500 receives and transmits RF signals within the first predetermined RF band and the second arm 506 is designed such that the antenna system 102 in accordance with the embodiment 500 receives and transmits RF signals within the second predetermined RF band.

In accordance with the second embodiment 500, the first capacitive patch 510 is located proximate to a portion (e.g., the end 512) of the first arm 504. The second capacitive patch 518 is located proximate to a portion (e.g., the end 520) of the second arm 506. The first switch 514 couples the first capacitive patch 510 to the ground plane 508 through the first impedance device 516, and the second switch 522 couples the second capacitive patch 518 to the ground plane 508 through the second impedance device 524. The value of the first and second impedance devices 516, 524 and the location of the first and second capacitive patches 510, 518 in relation to respective portions of the first and second arms 504, 506 are designed such that the antenna system 102 in accordance with the embodiment 500 receives and transmits RF signals within the third predetermined RF band when the first switch 514 is closed and the fourth predetermined RF band when the second switch 522 is closed.

A control routine within the controller 106 (FIG. 1) for the antenna system 102 can be provided which independently activates the first switch 514 and the second switch 522 to selectively provide reception and transmission of RF signals in the first, second, third, or fourth predetermined RF bands. Alternatively, a control routine for the antenna system 102 could be provided in the controller 106 which activates the first switch 514 and the second switch 522 together to switch from providing reception and transmission of RF signals in the first and second predetermined RF bands to providing reception and transmission of RF signals in the third and fourth predetermined RF bands.

Figure 8:
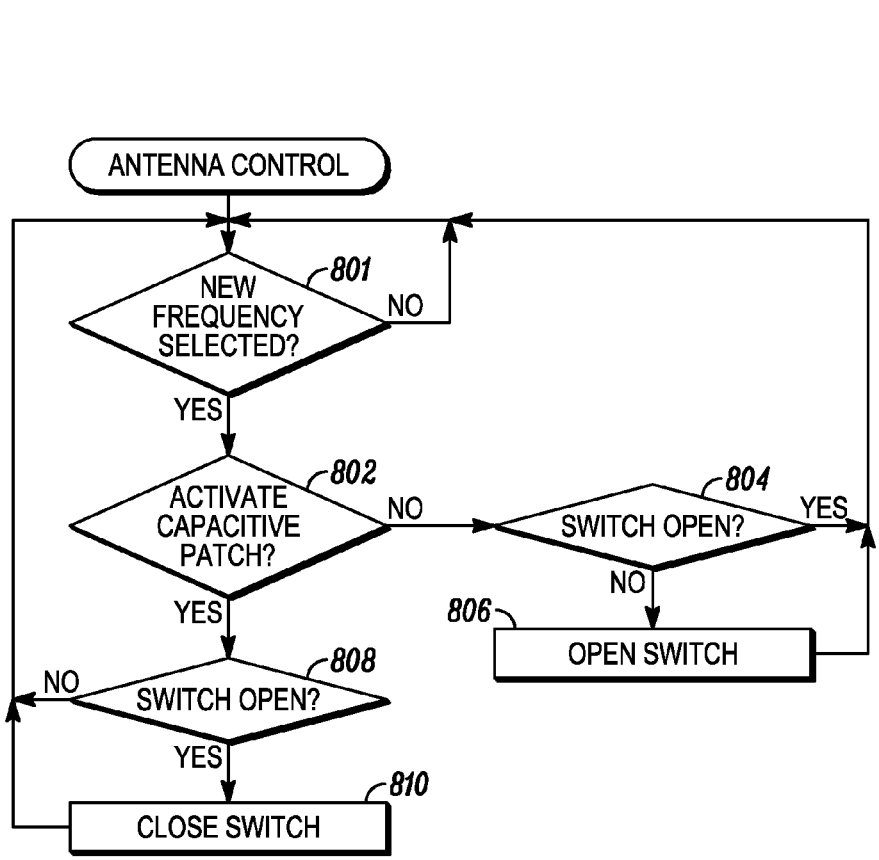
FIG. 8 is a flow diagram of a control method for the antenna system of FIGS. 2 and 4 to 7 in accordance with an embodiment of the invention.

Referring next to FIG. 8, a flowchart 800 represents a control routine for control of the antenna system 102 by the controller 106 in accordance with the first embodiment 200. This could be part of a frequency scanning operation or part of a frequency selection operation for a cellular telephone. The routine 800 initially determines whether a new frequency is selected 801. When a new frequency is selected 801, it is next determined whether the frequency selected is within a frequency band that requires activation 802 of the capacitive patch 212 (i.e., closing of the switch 214). If the frequency band of the frequency selected does not require activation 802 of a capacitive patch 212 (also expandable to applicable to the capacitive patch 212, 510, 518, etc.), and the switch 214 is open 804, processing returns to await detection of selection of another frequency 801.

If the frequency band of the frequency selected does not require activation 802 of the capacitive patch 212, and the switch 214 is not open 804, the switch 214 is opened 806 and processing returns to await detection of selection of another frequency 801.

If the frequency band of the frequency selected requires activation 802 of the capacitive patch 212, and the switch 214 is open 808, the switch 214 is closed 810 and processing returns to await detection of selection of another frequency 801. If the frequency band of the selected frequency requires activation 802 of the capacitive patch 212, and the switch 214 is not open 808, processing returns to await detection of selection of another frequency 801.

For use with the multi-resonant antenna system 500, the method 800 could be modified to provide either simultaneous operation of the two switches 514, 522 or independent operation thereof. Thus, when a new frequency is selected 801 it is determined not only whether to activate a capacitive patch 802, but also which capacitive patch 510, 518 to activate. Appropriate steps would be provided corresponding to steps 804, 806, 808 and 810 for each switch 514, 522 activation.

Thus, a multi-resonant, single feed, low profile antenna can beneficially provide reception and transmission within multiple predetermined RF bands by selectably accessing multiple cellular frequency bands (e.g., allowing operation to switch from dual band operation to tri- or quad-band operation). In addition, the positioning of the capacitive patch proximate to various locations of one or more of the arms of the single feed, low profile antenna can provide adjustment of one band of a tri-band operation to a fourth predetermined RF band for quad-band operation without disturbing the operation within the other two RF bands. While several exemplary embodiments have been presented in this detailed description, it should be appreciated that a vast number of variations also exist. It should also be appreciated that the exemplary embodiments are only examples, and are not intended to limit the scope, applicability, or configuration of the invention in any way. Rather, the foregoing detailed description will provide those skilled in the art with a convenient road map for implementing exemplary embodiments of the invention, it being understood that various changes may be made in the function and arrangement of elements described in an exemplary embodiment without departing from the scope of the invention as set forth in the appended claims.

What is claimed is:

1. An antenna system for receiving and transmitting radio frequency (RF) signals within predetermined RF bands, the antenna system comprising:

a ground plane;

a multi-resonant antenna element having a feed leg coupled at one portion thereof to the ground plane;

a first capacitive patch; and a first switching device associated with the first capacitive patch and selectably coupling the first capacitive patch to the ground plane for selectably receiving and transmitting RF signals within a first predetermined RF band or a second predetermined RF band, wherein the multi-resonant antenna element comprises a planar antenna element and the portion of the feed leg coupled to the ground plane is a first end of the planar antenna element, and wherein the first capacitive patch is located proximate to a second end opposite the first end, and wherein the first switching device is connected to the first capacitive patch and selectably couples the first capacitive patch to the ground plane.

2. The antenna system in accordance with claim 1 further comprising a first impedance device coupled between the first switching device and the ground plane, wherein the first switching device selectably alters an impedance of the antenna system to selectably receive and transmit RF signals within either the first predetermined RF band or the second predetermined RF band by selectably coupling the first capacitive patch to the first impedance device.

3. The antenna system in accordance with claim 2 wherein the first capacitive patch is directly connected to the first switching device, and wherein the first switching device selectably alters the impedance of the antenna system to receive and transmit RF signals within the first predetermined RF band or the second predetermined RF band by selectably connecting the first capacitive patch to the first impedance device.

4. A wireless communication device for receiving and transmitting radio frequency (RF) signals within a plurality of predetermined RF bands, the mobile communication device comprising:

a ground plane;

an antenna system coupled to the ground plane and comprising:

a multi-resonant antenna element having a feed leg coupled at one portion thereof to the ground plane;

a first capacitive patch; and a first switching device associated with the first capacitive patch for selectably coupling the first capacitive patch to the ground plane, wherein the multi-resonant antenna element includes a first arm tuned to receive and transmit within a first one of the plurality of predetermined RF bands and includes a second arm tuned to receive and transmit within a second one of the plurality of predetermined RF bands, and wherein the first capacitive patch is located proximate to either the first arm or the second arm; and a controller coupled to the first switching device for providing a first activation signal thereto for coupling the first capacitive patch to and uncoupling the first capacitive patch from the ground plane in order for the antenna system to receive or transmit RF signals within either the first one of the plurality of predetermined RF bands or a third one of the plurality of predetermined RF bands.

5. The wireless communication device in accordance with claim 4 wherein the antenna system further comprises:

a first impedance device coupled between the first switching device and the ground plane, and wherein the first switching device selectably alters an impedance of the antenna system from receiving and transmitting RF signals in the first one of the plurality of predetermined RF bands to receiving and transmitting RF signals in the third one of the plurality of predetermined RF bands by selectably coupling the first capacitive patch to the first impedance device.

6. The wireless communication device in accordance with claim 4 wherein the first capacitive patch is located proximate to a portion of the first arm, and wherein a second capacitive patch is located proximate to a portion of the second arm, and wherein the feed leg couples the multi-resonant antenna element to the ground plane at a location between an end of the first arm and an end of the second arm, and wherein a second switching device is connected to the second capacitive patch for selectably coupling the second capacitive patch to the ground plane for receiving and transmitting RF signals within either the second one of the plurality of predetermined RF bands or a fourth one of the plurality of predetermined RF bands.

7. The wireless communication device in accordance with claim 4 wherein the first capacitive patch is located proximate to the first arm and proximate to the second arm, and wherein the first switching device is associated with the first capacitive patch for selectably coupling the first capacitive patch to the ground plane to tune the first arm from receiving and transmitting RF signals within the first one of the plurality of predetermined RF bands to receiving and transmitting RF signals within the third one of the plurality of predetermined RF bands simultaneous with tuning the second arm from receiving and transmitting RF signals within the second one of the plurality of predetermined RF bands to receiving and transmitting RF signals within a fourth one of the plurality of predetermined RF bands.

8. The wireless communication device in accordance with claim 4 wherein the feed leg couples the multi-resonant antenna element to the ground plane at a location between an end of the first arm and an end of the second arm.

9. The wireless communication device in accordance with claim 8 wherein the multi-resonant antenna element comprises a planar inverted F antenna (PIFA).

10. The wireless communication device in accordance with claim 8 wherein the multi-resonant antenna element comprises a folded J antenna (FJA).

11. The wireless communication device in accordance with claim 4 wherein the first capacitive patch is located proximate to the first arm, and wherein the first switching device selectably couples the first capacitive patch to the ground plane to tune the first arm from receiving and transmitting RF signals within the first one of the plurality of predetermined RF bands to receiving and transmitting RF signals within the third one of the plurality of predetermined RF bands in response to the first activation signal.

12. The wireless communication device in accordance with claim 5 wherein the first capacitive patch is directly connected to the first switching device, and wherein the first switching device selectably alters the impedance of the antenna system from receiving and transmitting RF signals in the first one of the plurality of predetermined RF bands to receiving and transmitting RF signals in the third one of the plurality of predetermined RF bands by selectably connecting the first capacitive patch to the first impedance device.

13. The wireless communication device in accordance with claim 7 wherein the second capacitive patch is located proximate to an end of the second arm, and wherein the controller provides the first activation signal to the first switching device simultaneously with providing the second activation signal to the second switching device for coupling the second capacitive patch to and uncoupling the second capacitive patch from the ground plane simultaneously with coupling the first capacitive patch to and uncoupling the first capacitive patch from the ground plane.

14. A method for controlling an antenna system comprising a multi-resonant antenna structure having one or more arms and receiving and transmitting radio frequency (RF) signals within a plurality of predetermined RF bands, wherein the multi-resonant antenna structure includes a first arm tuned to receive and transmit within a first predetermined RF band and a second arm tuned to receive and transmit within a second predetermined RF band, the method comprising:

activating a first capacitive patch located proximate to the first arm by coupling the first capacitive patch to the first arm to alter an impedance of the first arm from receiving and transmitting RF signals within the first predetermined RF band to receiving and transmitting RF signals within a third predetermined RF band; and activating a second capacitive patch located proximate to the second arm by coupling the second capacitive patch to the second arm to alter the impedance of the second arm from receiving and transmitting RF signals within the second predetermined RF band to receiving and transmitting RF signals within a fourth predetermined RF band.

15. The method in accordance with claim 14 wherein activating the second capacitive patch includes:

activating the second capacitive patch by coupling the second capacitive patch to the second arm simultaneous with coupling the first capacitive patch to the first arm in order to alter the impedance of the second arm from receiving and transmitting RF signals within the second predetermined RF band to receiving and transmitting RF signals within the fourth predetermined RF band while simultaneously altering the impedance of the first arm from receiving and transmitting RF signals within the first predetermined RF band to receiving and transmitting RF signals within the third predetermined RF band.

* * * * *